US009251759B2

(12) United States Patent
Said et al.

(10) Patent No.: US 9,251,759 B2
(45) Date of Patent: Feb. 2, 2016

(54) REDUCTION OF CONTENTION BETWEEN DRIVER CIRCUITRY

(71) Applicant: APPLE INC., Cupertino, CA (US)

(72) Inventors: Taif Ahmed Said, Toronto (CA); Kevin J. White, Los Gatos, CA (US); Sang Y Youn, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 243 days.

(21) Appl. No.: 13/673,669

(22) Filed: Nov. 9, 2012

(65) Prior Publication Data

US 2014/0071111 A1 Mar. 13, 2014

Related U.S. Application Data

(60) Provisional application No. 61/699,765, filed on Sep. 11, 2012.

(51) Int. Cl.
*G09G 5/00* (2006.01)
*G09G 3/36* (2006.01)

(52) U.S. Cl.
CPC ..... *G09G 5/00* (2013.01); *G09G 3/3696* (2013.01); *G09G 2330/021* (2013.01); *G09G 2330/026* (2013.01)

(58) Field of Classification Search
CPC ..... G09G 3/3674; G09G 2310/0267; G09G 3/3655; G09G 5/00; G09G 3/3696
USPC ..... 345/211, 212
See application file for complete search history.

(56) References Cited

U.S. PATENT DOCUMENTS

| | | | | |
|---|---|---|---|---|
| 6,756,958 | B2 * | 6/2004 | Furuhashi et al. | 345/95 |
| 8,044,917 | B2 | 10/2011 | Oh et al. | |
| 8,089,437 | B2 | 1/2012 | Maekawa | |
| 8,537,126 | B2 * | 9/2013 | Yousefpor et al. | 345/173 |
| 2004/0095021 | A1 * | 5/2004 | Fogleman et al. | 307/52 |
| 2004/0104875 | A1 * | 6/2004 | Kim et al. | 345/87 |
| 2006/0001635 | A1 * | 1/2006 | Nakajima | 345/98 |
| 2007/0216671 | A1 * | 9/2007 | Oku et al. | 345/211 |
| 2008/0122778 | A1 * | 5/2008 | Hiraki et al. | 345/98 |
| 2009/0237387 | A1 | 9/2009 | Yoshiga | |
| 2010/0253638 | A1 | 10/2010 | Yousefpor et al. | |
| 2011/0310135 | A1 * | 12/2011 | Feng | 345/690 |
| 2012/0169698 | A1 | 7/2012 | Park et al. | |
| 2012/0188213 | A1 | 7/2012 | Nam et al. | |
| 2013/0135245 | A1 * | 5/2013 | Rai et al. | 345/174 |

* cited by examiner

*Primary Examiner* — Quan-Zhen Wang
*Assistant Examiner* — Xuemei Zheng
(74) *Attorney, Agent, or Firm* — Fletcher Yoder PC

(57) ABSTRACT

An electronic display includes a display panel. The display panel includes a pixel array and receives a supply voltage. The display panel also includes a panel driver configured to generate a gate line voltage. The panel driver also supplies the gate line voltage to the display panel based on a comparison between the gate line voltage and the supply voltage.

15 Claims, 5 Drawing Sheets

REDUCTION OF CONTENTION BETWEEN DRIVER CIRCUITRY

CROSS REFERENCE TO RELATED APPLICATIONS

This application is a Non-Provisional Patent Application of U.S. Provisional Patent Application No. 61/699,765, entitled "Reduction of Contention Between Driver Circuitry", filed Sep. 11, 2012, which is herein incorporated by reference.

BACKGROUND

The present disclosure relates generally to controlling the operating parameters of an electronic device display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs) and organic light-emitting diode (OLED) displays, are commonly used in electronic devices such as televisions, computers, and phones. LCDs portray images by modulating the amount of light that passes through a liquid crystal layer within pixels of varying color. OLED displays portray images by modulating light produced by pixels of varying color. A display driver for LCDs and OLED produces images on the display by adjusting the image signal supplied to each pixel across the display.

Display drivers and panel drivers may be both utilized in conjunction with the electronic displays discussed above to change the image signals supplied to the pixels based on input supplied to the display driver and/or the panel drivers. When the display is powered up, contention between these drivers may occur. This contention may lead to overall reliability issues for the display, the driver circuits, and or the power unit of the display and/or a device housing the display. Accordingly, it may be desirable to reduce any potential power up contentions between a panel driver and display driver of a given display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

A system, method, and device for supplying a gate voltage to pixels of a display. An electronic display includes a display panel that receives a supply voltage. This supply voltage may be the voltage supplied as the gate voltage at a first time. The display may also include a panel driver. The panel driver may receive a reference voltage and convert that reference voltage into an amplified voltage to be supplied as the gate voltage. Moreover, through a comparison of the supply voltage and the amplified voltage, the display panel may determine which of the supply voltage and the amplified voltage are to be supplied as the gate voltage. This determination may allow for reductions in potential faults that may otherwise occur due to discontinuities between the supply voltage and the amplified voltage during certain periods of operation, for example, startup of the electronic display.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As mentioned above, embodiments of the present disclosure relate to a display and, more specifically, to a panel driver therein. Faults that might otherwise be present due to discontinuities between separate voltages to be supplied to pixels of the display may be mitigated through the use of the panel driver as a comparison unit for the separate voltages during certain periods of operation. That is, the panel driver may selectively output a voltage to be transmitted as a gate line voltage based on the operating conditions of the display.

Figure 1:
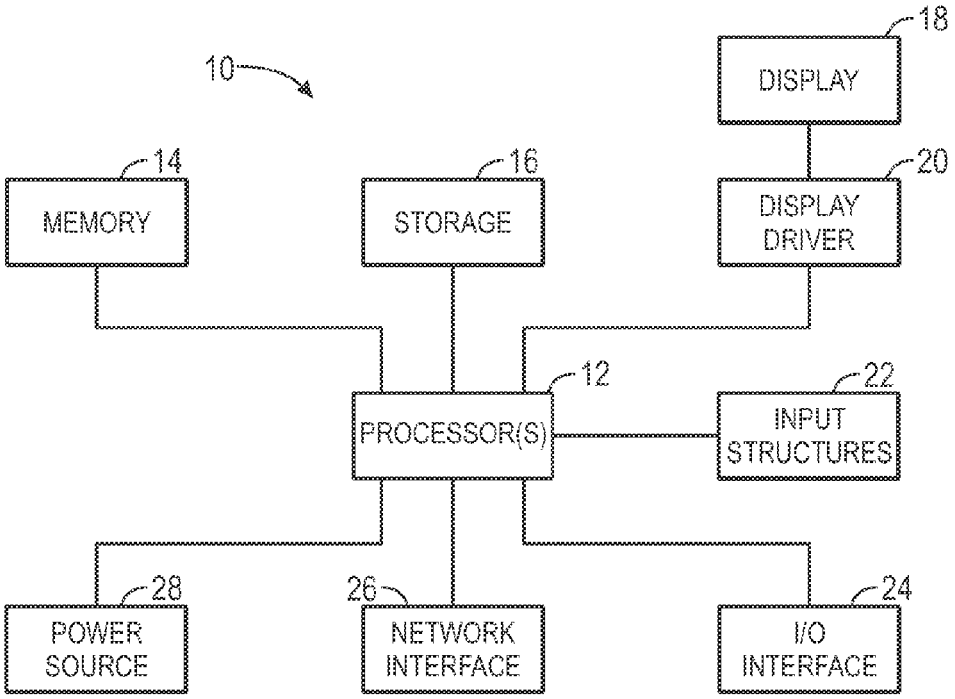
FIG. 1 is a schematic block diagram of an electronic device with a display driver having a clock detect circuit to reduce turn-on time of the display, in accordance with an embodiment.
Figure 2:
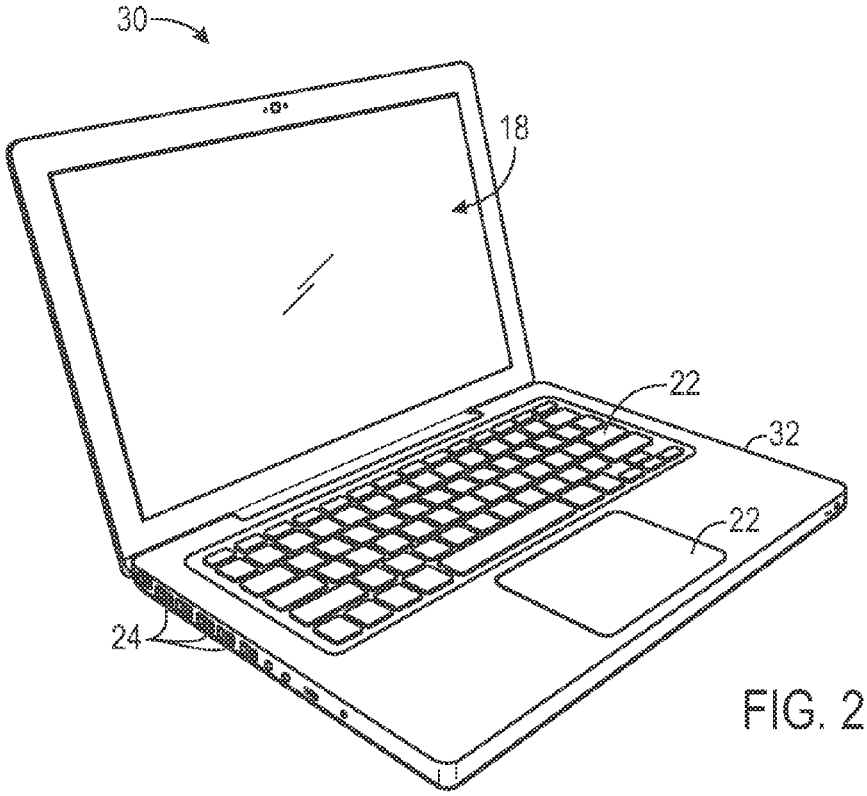
FIG. 2 is a perspective view of a notebook computer representing an embodiment of the electronic device of FIG. 1.
Figure 3:
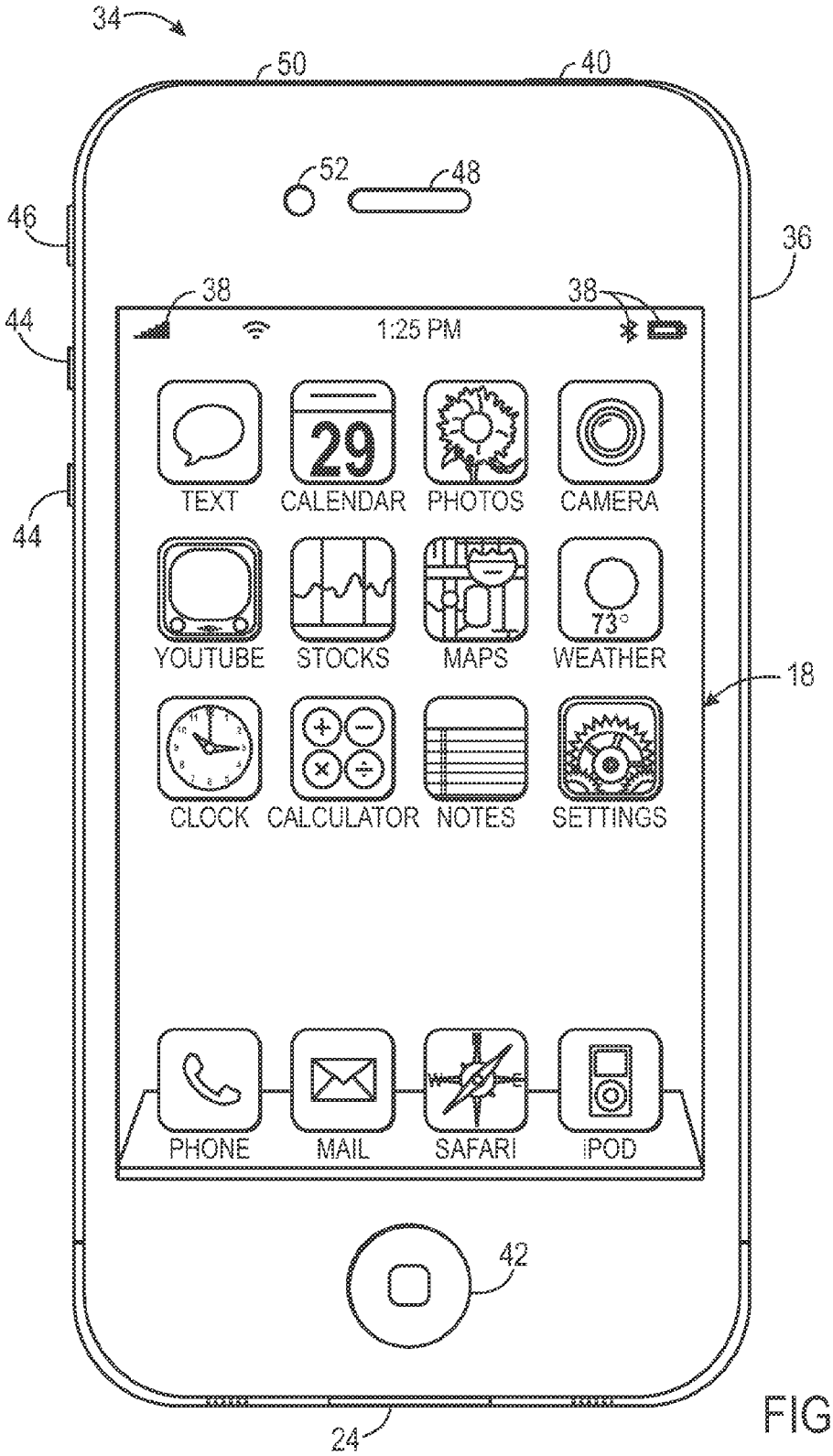
FIG. 3 is a front view of a handheld device representing another embodiment of the electronic device of FIG. 1.

With the foregoing in mind, a general description of suitable electronic devices that may employ electronic displays having such a panel driver will be provided below. In particular, FIG. 1 is a block diagram depicting various components that may be present in an electronic device suitable for use with such a display and panel driver. FIGS. 2 and 3 respectively illustrate perspective and front views of a suitable electronic device, which may be, as illustrated, a notebook computer or a handheld electronic device.

Turning first to FIG. 1, an electronic device 10 according to an embodiment of the present disclosure may include, among other things, one or more host(s) or processor(s) 12, memory 14, nonvolatile storage 16, a display 18 having a display driver 20 for driving the display 18 when the display 18 is turned on, input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10.

By way of example, the electronic device 10 may represent a block diagram of the notebook computer depicted in FIG. 2, the handheld device depicted in FIG. 3, or similar devices. It should be noted that the host(s) 12 and/or other data processing circuitry may be generally referred to herein as "data processing circuitry" or "host." This host may be embodied wholly or in part as software, firmware, hardware, or any combination thereof. Furthermore, the host 12 may be a single contained processing module or may be incorporated wholly or partially within any of the other elements within the electronic device 10. The host 12 may control the electronic display 18 by determining when the electronic display 18 is to be turned on as well as by issuing data signals to the display driver 20. The display driver 20 may start up by driving the display 18 to generate an image based on signals received from the host 12.

In the electronic device 10 of FIG. 1, the host(s) 12 and/or other data processing circuitry may be operably coupled with the memory 14 and the nonvolatile memory 16 to execute instructions. Such programs or instructions executed by the host(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the host(s) 12.

The display 18 may be a touch-screen liquid crystal display (LCD) or an OLED display, for example, which may enable users to interact with a user interface of the electronic device 10. In some embodiments, the electronic display 18 may be a MultiTouch™ display that can detect multiple touches at once. As will be described further below, the display driver 20 may provide signals to the display 18 to generate images therein. Additionally, power signals may be transmitted from the display driver 20 to the display 18, as will be described in greater detail below.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter. In some embodiments, the power source 28 may also operate to provide power to power control circuitry utilized to power various components of the device 10.

The electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30, is illustrated in FIG. 2 in accordance with one embodiment of the present disclosure. The depicted computer 30 may include a housing 32, a display 18, input structures 22, and ports of an I/O interface 24. In one embodiment, the input structures 22 (such as a keyboard and/or touchpad) may be used to interact with the computer 30, such as to start, control, or operate a GUI or applications running on computer 30. For example, a keyboard and/or touchpad may allow a user to navigate a user interface or application interface displayed on the display 18. Further, the display 18 may include the display driver 20.

FIG. 3 depicts a front view of a handheld device 34, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif. In other embodiments, the handheld device 34 may be a tablet-sized embodiment of the electronic device 10, which may be, for example, a model of an iPad® available from Apple Inc.

The handheld device 34 may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices.

User input structures 40, 42, 44, and 46, in combination with the display 18, may allow a user to control the handheld device 34. For example, the input structure 40 may activate or deactivate the handheld device 34, the input structure 42 may navigate a user interface to a home screen, a user-configurable application screen, and/or activate a voice-recognition feature of the handheld device 34, the input structures 44 may provide volume control, and the input structure 46 may toggle between vibrate and ring modes. A microphone 48 may obtain a user's voice for various voice-related features, and a speaker 50 may enable audio playback and/or certain phone capabilities. A headphone input 52 may provide a connection to external speakers and/or headphones. As mentioned above, the display 18 may include the display driver 20.

Figure 4:
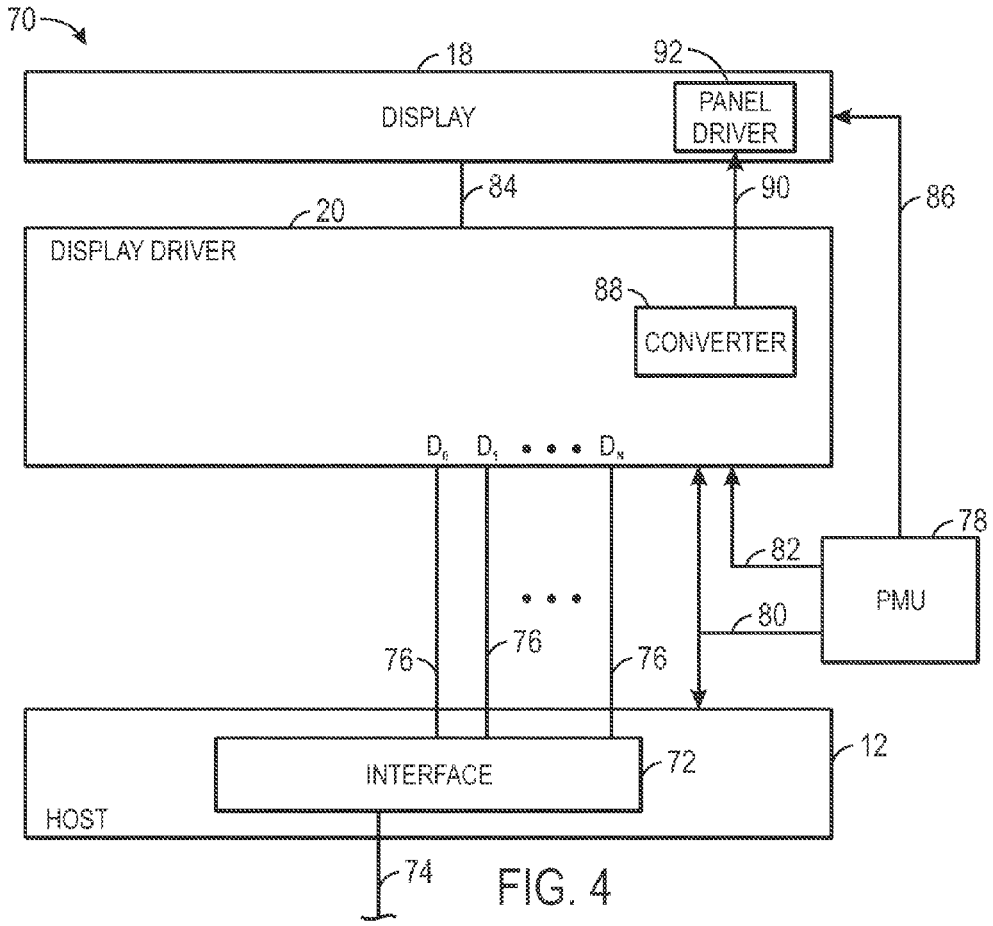
FIG. 4 is a block diagram illustrating the display driver and a panel driver of the electronic device of FIG. 1, in accordance with an embodiment.

FIG. 4 generally represents a block diagram of certain components of the electronic device 10, including the host 12, the display driver 20, and the display 18. The host 12 may be configured supply signals to the display driver 20 so that the display driver 20 may drive the display 18 to produce images based on the supplied signals. For example, the host 12 may process code or instructions to display images on the display 18. The host 12 may supply data signals (e.g., $D_0, D_1 \ldots D_N$) to the display driver 20 as data packets of information from an interface 72, such as a Mobile Industry Processor Interface (MIPI). In some embodiments, the host 12 may include more than one interface 72. The host 12 is configured to supply a number of signals (e.g., data signals) through the interface 72 along a number of connections 76. In some embodiments, the interface 72 may also receive and supply signals along the number of connections 74 with other components of the electronic device 10 as discussed above with FIG. 1. The display driver 20 processes the data signals and drives a number of pixels of one or more colors arrayed across the display 18 to produce images. The display driver 20 may be configured to drive the number of pixels by adjusting the voltage and/or current supplied to each pixel to adjust the color and/or brightness of each pixel to produce the images according to the supplied data signals from the host 12.

A power management unit (PMU) 78 may be coupled to the host 12 and display driver 20 to supply low voltage on connection 80 to the host 12 and the display driver for processing signals. In this manner, the PMU 78 may operate as a power supply and may be part of power source 28 and/or may convert power received from power source 28 for use by various the elements of the electronic device 10.

The display 18 may require a higher voltage to operate than the host 12 and/or display driver 20. The PMU 78 may be configured to supply a high voltage (HV) signal on connection 82 to the display driver 20 to drive the display 18 to produce images. In some embodiments, the low voltage signal may be sufficient only for processing of the data signals with digital circuitry within the display driver, whereas the high voltage signal HV is sufficient for powering the analog circuitry of the display 18. The PMU 78 may supply the high voltage signal HV on demand upon receiving a power enable signal from the display driver 20. In some embodiments, the display driver 20 may be configured to supply the power enable signal after receiving a certain set of data signals, such as a power packet from the host 12. The power packet may be received as one or more data signals from the interface 72. By controlling the power packet, the host 12 in this embodiment may be configured to control the timing and supply of the high voltage signal HV supplied to the display driver 20 by the PMU 78.

The data driver 20 supplied with the high voltage signal HV may be in a state (e.g., active state) configured to process data signals into image signals to drive the display 18. The display driver 20 may receive data signals as data packets. Each data packet may include code or instructions for images to be displayed on the display 18. The display driver 20 in the active state is configured to process the data packets to image signals to drive each pixel across the display 18. The image signals are applied voltages configured to affect the color and brightness of each pixel. The display driver 20 may produce one or more images on the display 18 based on the received data signals by controlling the color and brightness of each pixel across the display 18. In some embodiments, signals for generating these images may be transmitted from the display driver 20 to the display 18 along connection 84.

In some embodiments, the PMU 78 may also provide a supply voltage AVDDN along connection 86 to the display 20. This supply voltage AVDDN may be directly provided by the PMU 78 or may be transmitted via display driver 20. The display driver 20 may also include at least one power converter 88. This power converter 88 may provide a reference voltage Vglref along connection 90 to, for example, a panel driver 92 of the display 18. This panel driver 92 may operate to provide a Vcpl voltage to the display 18. The Vcpl voltage may be a gate line voltage that is used to turn on and off particular display lines of the display when the lines are addressed.

Figure 5:
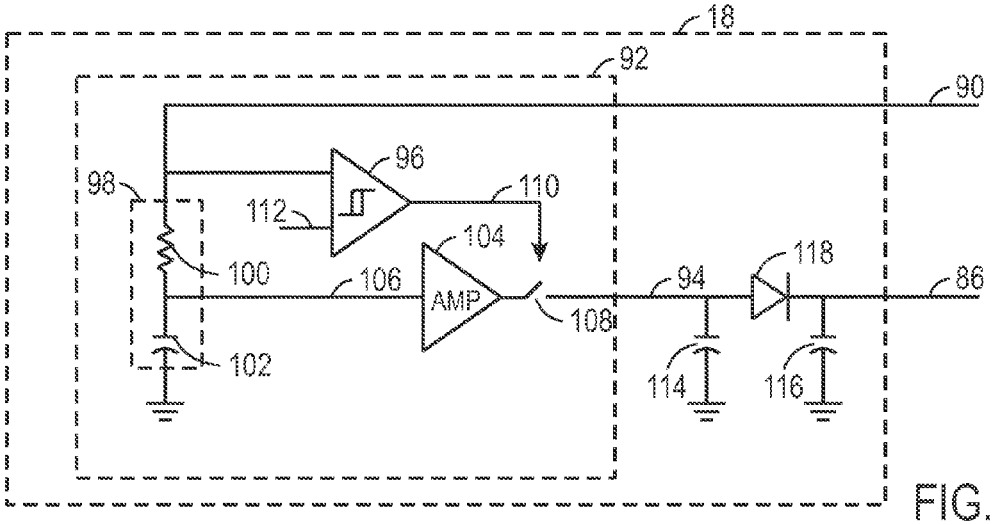
FIG. 5 is a block diagram illustrating components of the display driver and the panel driver of FIG. 4, in accordance with an embodiment.

FIG. 5 illustrates a more detailed illustration of the display 18. As previously noted, display 18 includes the panel driver 92. This panel driver 92 may receive the reference voltage Vglref along connection 90 and may provide the Vcpl voltage along connection 94. As illustrated this Vcpl along connection 90 may be generated based at least in part on the on the reference voltage Vglref. The reference voltage Vglref may be received at the panel driver 92, whereby the reference voltage Vglref may be provided to a comparator 96 as well as filtered by filter 98 to generate a filtered reference voltage Vglref_f. In one embodiment, the filter 98 may be a low pass filter that includes a resistor 100 and a capacitor 102, whereby the resistor 100 may have a resistance of, for example, 10 kΩ, 50 kΩ, 100 kΩ, or another value, while the capacitor 102 may have a capacitance of, for example, 0.05 μF, 0.1 μF, 0.2 μF, or another value. In one embodiment, the filtered reference voltage Vglref_f may be provided to an amplifier 104 along connection 106. The amplifier 104 may, for example, amplify and invert the filtered reference voltage Vglref_f by a value of approximately −2, −3, −3.5, −4, −4.5, −5, or by another value. The voltage exiting the amplifier 104 may be coupled to connection 94 to provide the Vcpl voltage to the display 18.

Additionally, the panel driver 92 may include a switch 108 that may selectively couple the output of amplifier 104 to the connection 94. This switch may be operatively controlled by a signal provided from the comparator 96 along connection 110. In some embodiments, the output of the comparator 96 is determined based on a comparison of the reference voltage Vglref against a reference voltage provided along connection 112 to the comparator 96. The reference voltage provided along connection 112 may be a fixed value of, for example, approximately 1.0 V, 1.1 V, 1.2 V, 1.3 V, 1.4 V, 1.5 V, or another value. Based on the comparison of this fixed reference voltage with the reference voltage Vglref, a signal is transmitted to the switch 108 to open or close the switch 108, thus altering the Vcpl voltage value provided along connection 94.

Additionally, the display 18 may also include additional circuitry, such as capacitor 116, capacitor 118, and diode 118. It should also be noted that the capacitor 116 and diode 118 may be physically present in the display driver 20 instead of the display 18. Capacitor 114 may operate to smooth the Vcpl voltage and may have a capacitance of, for example, 5 μF, 5.5 μF, 5.7 μF, 6 μF, or another value. Similarly, capacitor 116 may operate to smooth the supply voltage AVDDN and may have a capacitance of, for example, 10 μF, 20 μF, 30 μF, 40 μF, or another value. Additionally, as noted above, the display 18 may include the diode 118, which may be, for example, a Schottkey diode, and the diode 118 may aid in protecting the PMU 78 from excessive current (e.g., current surges).

As illustrated, the panel driver 92 may generate a Vcpl voltage to provide to the display 18. This Vcpl voltage may remain above the supply voltage AVDDN so as to minimize current flowing along connection 86 to the PMU 78, which could reduce the reliability of the PMU 78 (e.g., sinking charge flowing along connection 86 may adversely affect the reliability and lifespan of the PMU 78). Additionally, the reliability of the diode 118 may be reduced if the Vcpl voltage dips below the supply voltage AVDDN. One occurrence of this situation is illustrated in FIG. 6.

Figure 6:
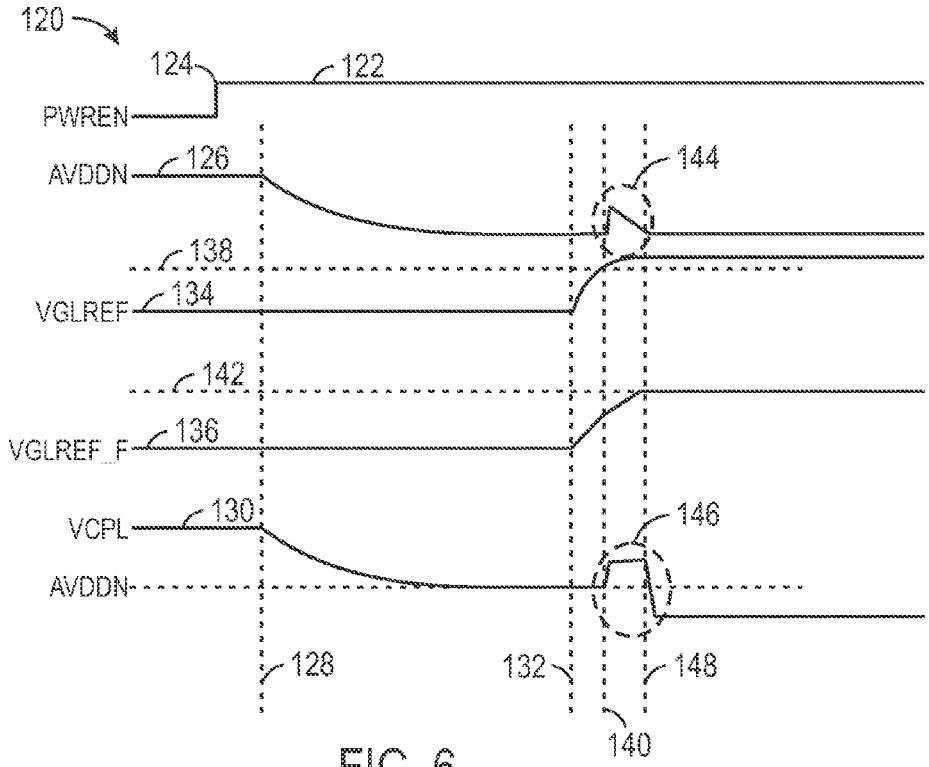
FIG. 6 is a voltage diagram for the display driver and the panel driver of FIG. 4, in accordance with an embodiment.

FIG. 6 illustrates a voltage diagram 120 related to the powering on of the device 10. Voltage line 122 may correspond to a power enable signal that goes high at a first time 124. This may correspond to the device 10 being powered on and/or revived from a sleep mode. In response to the power enable signal going high, the supply voltage AVDDN may begin to drop, as illustrated by voltage line 126, at a second time 128. Since the supply voltage AVDDN provided on connection 86 is coupled to the connection 94 supplying the Vcpl voltage (e.g., via diode 118), voltage line 130 representing the Vcpl voltage follows the supply voltage AVDDN starting at time 128.

At time 132, the reference voltage Vglref, corresponding to voltage line 134, may be provided along connection 90. As previously noted the reference voltage Vglref may also be used to generate filtered reference voltage Vglref_f, which may be illustrated by voltage line 136. As illustrated, the reference voltage Vglref increases towards the value of the reference voltage provided along connection 112 to the comparator 96, represented by line 138. Time 140 illustrates the time at which the reference voltage Vglref exceeds the reference voltage provided along connection 112 to the comparator 96. At this time, the output of the comparator 96 switches and operates to close switch 108. However, at time 140, the filtered reference voltage Vglref_f may not have reached its target value, represented by line 142. Accordingly, the filtered reference voltage Vglref_f being amplified and supplied along connection 96 may be higher than the supply voltage AVDDN being supplied along connection 84, causing the Vcpl voltage to be higher than the supply voltage AVDDN at diode 118, as illustrated in circled regions 144 and 146, until time 148, at which time the filtered reference voltage Vglref_f realizes the target value represented by line 142 and, thus, drives the Vcpl voltage to its steady state voltage. This causes a discontinuity during the times 140 and 148 causes current to flow along connection 86 to the PMU 78 and may damage both the diode 118 and the PMU 78.

Figure 7:
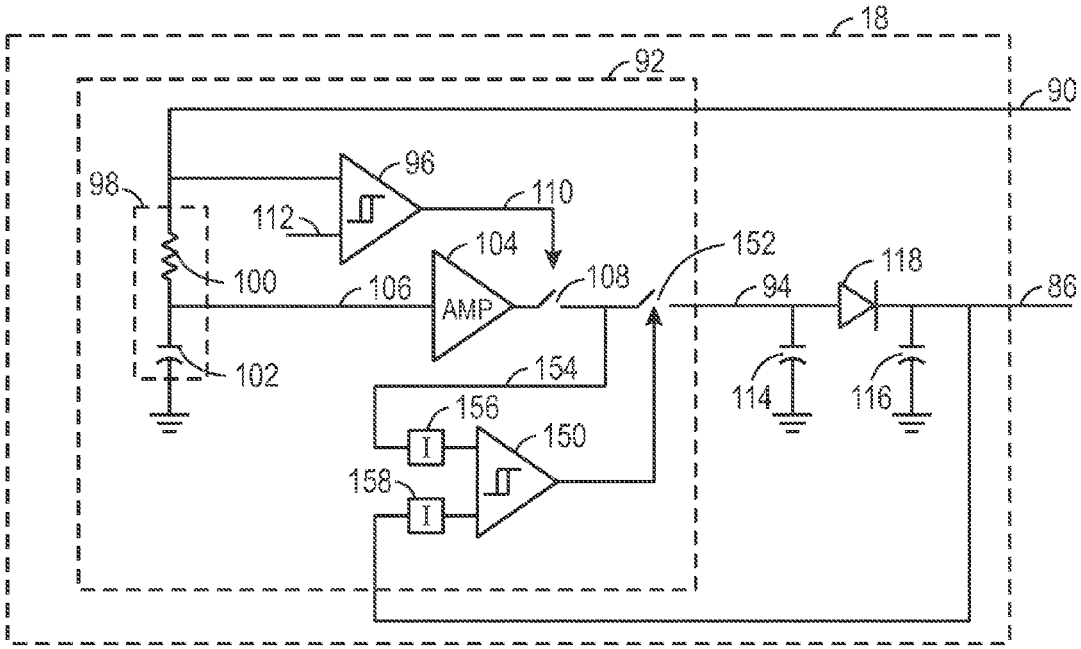
FIG. 7 is a second block diagram illustrating components of the display driver and the panel driver of FIG. 4, in accordance with an embodiment.

FIG. 7 illustrates a second embodiment of the panel driver 92 that includes a comparator 150 and a switch 152. The comparator 150 may be functionally similar to the comparator 96 and may operate to compare the Vcpl voltage and the supply voltage AVDDN. The comparator 150 may provide, for example, a low signal while the supply voltage AVDDN is greater than the Vcpl voltage (e.g., the amplified filtered reference voltage Vglref_f provided on connection 154), causing the switch 152 to remain open. When the Vcpl voltage on connection 154 exceeds the supply voltage AVDDN, the comparator 150 may output, for example, a high signal that causes the switch to close, thus allowing the Vcpl voltage (e.g., the amplified filtered reference voltage Vglref_f provided on connection 154) to be transmitted to the display 18. This corresponds to the steady state voltage for the Vcpl voltage subsequent to time 148 discussed above with respect to FIG. 6. In this manner the discontinuities illustrated in circled regions 144 and 146 of FIG. 6 may be avoided, thus prevented unwanted current from flowing to the PMU 78 and, accordingly, reducing potential reliability issues arising therefrom.

In some embodiments, the panel driver 92 of FIG. 7 also may include a polarity inverter 156 and a polarity inverter 158. Polarity inverters 156 and 158 may be coupled to the input terminals of the comparator 150 and may operate to invert the polarity of the Vcpl voltage and the supply voltage AVDDN, respectively. In this manner, the polarity inverters 156 and 158 may allow for the magnitudes of the values of the Vcpl voltage and the supply voltage AVDDN to be compared by comparator 150.

Figure 8:
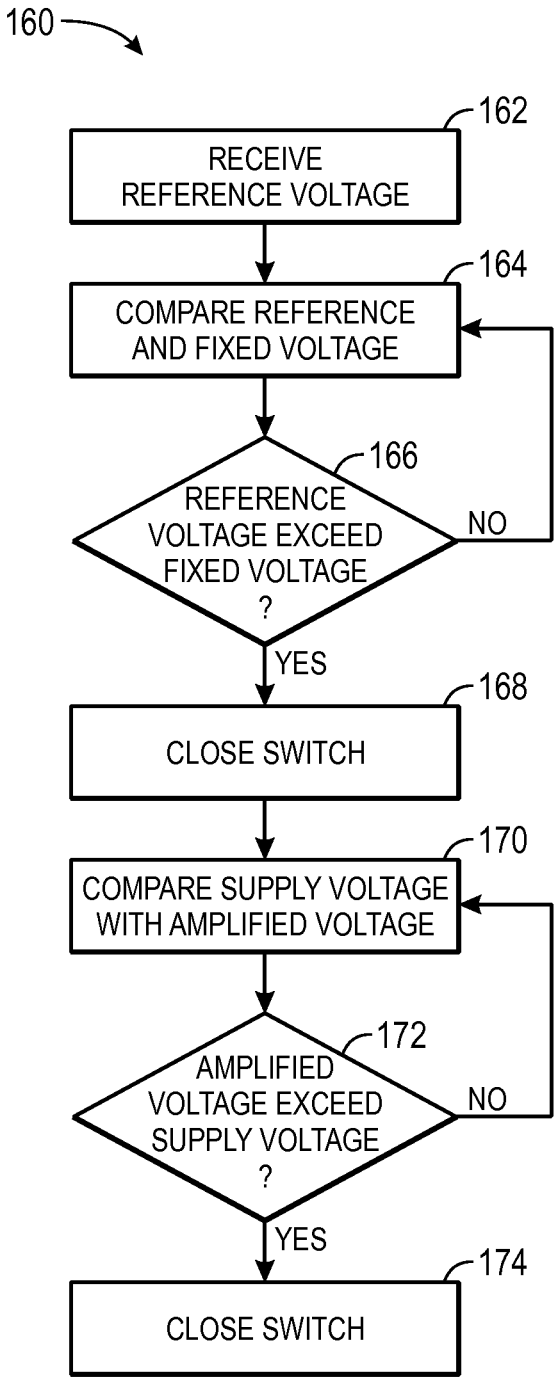
FIG. 8 is a flow chart illustrating the operation of the panel driver of FIG. 7, in accordance with an embodiment.

FIG. 8 illustrates a flow chart 160 corresponding to the operation of the panel driver 92 of FIG. 7. In step 162, a reference voltage Vglref is received at panel driver 92. This reference voltage Vglref is filtered to generate filtered reference voltage Vglref_f and amplified. However, before the amplified filtered reference voltage Vglref_f is transmitted from the panel driver 92, at step 164, a comparison is made between the reference voltage Vglref and the reference voltage provided along connection 112 by the comparator 96.

As seen in step 166, a determination is made in the comparator 96 of whether the reference voltage Vglref exceeds the reference voltage provided along connection 112. If the reference voltage Vglref does not exceed the value of the reference voltage provided along connection 112 in step 166, then the process returns to step 164. If, however, the reference voltage Vglref exceeds the value of the reference voltage provided along connection 112 in step 166, then the process continues to step 168, whereby the switch 108 is closed based on the signal provided on connection 110.

In step 170, the amplified filtered reference voltage Vglref_f is compared with the supply voltage AVDDN in comparator 150 to determine whether the amplified filtered reference voltage Vglref_f exceeds the supply voltage AVDDN. If the amplified filtered reference voltage Vglref_f does not exceed the value of the supply voltage AVDDN provided along connection 86 in step 172, then the process returns to step 170. If, however, the amplified filtered reference voltage Vglref_f exceeds the value of the supply voltage AVDDN provided along connection 86 in step 172, then the process continues to step 174, whereby the switch 152 is closed based on the signal provided by the comparator 150. This allows the amplified filtered reference voltage Vglref_f to be provided as the Vcpl voltage on connection 94 to display 18.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic display comprising:

a display panel comprising a pixel array, wherein the display is configured to receive a supply voltage and a gate line voltage; and a panel driver comprising an amplifier that receives and amplifies a reference voltage to generate an amplified reference voltage as the gate line voltage and a control circuitry that selectively provides the gate line voltage along a path to the display panel, wherein the control circuitry comprises:

a first comparator comprising a first input terminal to receive the reference voltage, a second input terminal to receive a threshold voltage, and a first output terminal to output a first control signal when the reference voltage is greater than the threshold voltage;

a first switch along the path to the display panel that is closed upon receiving the first control signal;

a second comparator comprising a third input terminal to receive the supply voltage, a fourth input terminal to receive the amplified reference voltage when the first switch is closed, and a second output terminal to output a second control signal when the supply voltage is greater than the gate line voltage; and a second switch along the path to the display panel that is closed upon receiving the second control signal, wherein closing the second switch enables providing the gate line voltage to the display.

2. The electronic display of claim 1, wherein the first switch is configured to remain open when the reference voltage is less than the threshold voltage.

3. The electronic display of claim 1, wherein the panel driver comprises a third output configured to provide the gate line voltage to the display panel, and the second switch is configured to selectively provide the gate line voltage from the path to the third output.

4. A display panel driver comprising:

a first input configured to receive a reference voltage;

a second input configured to receive a supply voltage;

an output configured to provide a gate line voltage;

an amplifier configured to amplify the reference voltage to generate an amplified reference voltage as the gate line voltage;

a first switch configured to selectively provide the gate line voltage along a path to the output based on a first control signal;

a first comparator configured to generate the first control signal based on a comparison of the reference voltage and a threshold voltage;

a second switch configured to selectively provide the gate line voltage to the output based on a second control signal; and a second comparator configured to generate the second control signal based on a comparison of the gate line voltage with the supply voltage to prevent a current flowing from the output from flowing to a source of the supply voltage.

5. The display panel driver of claim 4, wherein the amplified reference voltage is provided along the path as the gate line voltage.

6. The display panel driver of claim 4, wherein the first switch is configured to receive the first control signal from the first comparator, and wherein the first control signal closes the first switch when the reference voltage is greater than the threshold voltage.

7. The display panel driver of claim 4, comprising a polarity inverter coupled to an input of the second comparator and configured to invert the polarity of one of the supply voltage or the gate line voltage.

8. A method comprising:

receiving a supply voltage at a panel driver;

receiving a reference voltage at the panel driver;

amplifying the reference voltage to generate an amplified reference voltage as a gate line voltage;

selectively providing the gate line voltage along a path to an output of the panel driver, wherein the gate line voltage is selectively provided along the path based on a comparison between the reference voltage and a threshold voltage; and selectively outputting the gate line voltage from the panel driver, wherein the gate line voltage is selectively outputted based on a comparison of the gate line voltage with the supply voltage to prevent a current of the gate-line voltage from flowing from the panel driver to a source of the supply voltage.

9. The method of claim 8, wherein the amplified reference voltage is selectively provided along the path as the gate line voltage.

10. The method of claim 8, wherein the threshold voltage comprises a fixed voltage and the comparison between the reference voltage and the threshold voltage is provided by a comparator generating a control signal.

11. The method of claim 10, comprising selectively providing the amplified reference voltage along a path as the gate line voltage based on the control signal.

12. A display panel driver comprising:

a first input configured to receive a supply voltage;

a second input configured to receive a reference voltage;

an amplifier configured to amplify the reference voltage to generate an amplified reference voltage to operate as a gate line voltage;

a first switch configured to selectively provide the gate line voltage along a path to an output of the display panel driver after the reference voltage reaches a fixed voltage; and the output configured to selectively provide the gate line voltage based on a comparison of the gate line voltage with the supply voltage to prevent a current of the gate line voltage from flowing to a source of the supply voltage, wherein the gate line voltage is provided by the output when the gate line voltage falls below the supply voltage.

13. The display panel driver of claim 12, comprising a comparator configured to compare the reference voltage with the fixed voltage and generate a control signal based on the comparison.

14. The display panel driver of claim 13, wherein the first switch is configured to receive the control signal from the comparator and selectively provide the amplified reference voltage along the path as the gate line voltage based on the control signal.

15. The display panel driver of claim 14, comprising a second switch configured to selectively provide the gate line voltage to the output when the gate line voltage falls below the supply voltage.

* * * * *